US005695386A

United States Patent [19]

Ryoke et al.

[11] Patent Number: 5,695,386

[45] Date of Patent: Dec. 9, 1997

[54] CLEANING METHOD USING ABRASIVE TAPE

[75] Inventors: Katsumi Ryoke; Keisuke Yamada; Masaaki Fujiyama, all of Kanagawa-ken, Japan

[73] Assignee: Fuji Photo Film Co., Ltd., Kanagawa, Japan

[21] Appl. No.: 698,271

[22] Filed: Aug. 15, 1996

Related U.S. Application Data

[63] Continuation of Ser. No. 287,935, Aug. 9, 1994, abandoned.

[30] Foreign Application Priority Data

Aug. 10, 1993 [JP] Japan ..... 5-198470

[51] Int. Cl.[6] ..... B24B 21/00

[52] U.S. Cl. ..... 451/41; 451/59; 451/296; 451/307

[58] Field of Search ..... 451/41, 59, 296, 451/300, 301, 303, 305, 307

[56] References Cited

U.S. PATENT DOCUMENTS

| | | | |
|---|---|---|---|
| 2,581,414 | 1/1952 | Hochberg | 241/22 |
| 2,855,156 | 10/1958 | Hochberg et al. | 241/22 |
| 3,943,666 | 3/1976 | Dion et al. | 451/307 |
| 4,179,852 | 12/1979 | Barnett | 451/307 |
| 4,347,689 | 9/1982 | Hammond | 451/307 |
| 4,388,368 | 6/1983 | Hibino et al. | 428/336 |
| 4,656,790 | 4/1987 | Mukai et al. | 451/303 |
| 4,841,683 | 6/1989 | Williams | 451/307 |
| 5,012,618 | 5/1991 | Price et al. | 451/307 |
| 5,209,027 | 5/1993 | Ishida et al. | 451/303 |
| 5,307,593 | 5/1994 | Lucker et al. | 451/300 |
| 5,375,285 | 12/1994 | Miura et al. | 451/307 |
| 5,431,592 | 7/1995 | Nakata | 451/307 |

FOREIGN PATENT DOCUMENTS

| | | |
|---|---|---|
| 57-123532 | 8/1982 | Japan . |
| 59-116926 | 7/1984 | Japan . |
| 59-142741 | 8/1984 | Japan . |
| 59-165239 | 9/1984 | Japan . |
| 61-129731 | 6/1986 | Japan . |
| 62-37451 | 8/1987 | Japan . |

*Primary Examiner*—Eileen P. Morgan
*Attorney, Agent, or Firm*—Sughrue, Mion, Zinn, Macpeak & Seas, PLLC

[57] ABSTRACT

An abrasive tape having an abrasive layer primarily containing abrasive grains and a binder and formed on a flexible substrate and a member to be cleaned are fed in substantially opposite directions with the abrasive layer and a surface of the member kept in contact with each other with the ratio of the feed rate of the member to the feed rate of the abrasive tape kept not higher than 1/1.

9 Claims, No Drawings

CLEANING METHOD USING ABRASIVE TAPE

This is a continuation of application Ser. No. 08/287,935, filed Aug. 9, 1994, now abandoned.

BACKGROUND OF THE INVENTION

1. Field of the Invention

This invention relates to a cleaning method for removing extrinsic substances on a surface without damaging the surface, and more particularly to a cleaning method for removing extrinsic substances on a surface by use of an abrasive tape comprising a flexible substrate and an abrasive layer formed on the substrate.

2. Description of the Prior Art

A silicon wafer used as a substrate for an IC, an aluminum substrate used as a substrate for a magnetic disk, a glass substrate for a liquid-crystal display, a polycarbonate or glass substrate used as a substrate for a photomagnetic recording medium and the like should have a surface which is extremely clean and free from a scratch.

In these substrates, substances from the human body such as components of sweat (e.g., protein, Na, Mg and bilirubin) and fatty components (e.g., trycetine); dust-resistant coating components such as alkyd resin, urethane resin and wall materials of inorganic silicon materials; components of antistatic agents such as carbon-containing resins and doping resins for antistatic agents); substances from processing materials such as solder flux, sealing resin and oilless resin; and splash of the materials of the substrates such as silicon, glass, aluminum, liquid-crystal and ITC film which exist in a clean room or the like adhere to the surface of the Substrates as extrinsic stain, which results in deterioration in the yield and/or the service life of the substrates or the final products. Accordingly, the substrates must be cleaned by removing such extrinsic substances before the subsequent steps.

As the method of cleaning such a member, there have been generally used a method in which the surface of the member is washed with alcohol solvents or fluorine solvents such fluorine 113 or a method in which the stain on the surface of the member is scraped off with a knife edge of an edge tool. However the former method in which solvent is used is disadvantageous in that it involves a problem of the danger of ignition, air pollution, destruction of ozonosphere and the like, and the latter method in which an edge tool is used is disadvantageous in that there is a fear of scratching the surface of the member to be cleaned.

SUMMARY OF THE INVENTION

In view of the foregoing observations and description, the primary object of the present invention is to provide a cleaning method which can remove extrinsic substances from a surface of a member without scratching the surface with a high efficiency and a high yield.

In accordance with the method of the present invention, an abrasive tape having an abrasive layer primarily containing abrasive grains and a binder and formed on a flexible substrate and a member having a surface to be cleaned are fed in substantially opposite directions with the abrasive layer and the surface of the member kept in contact with each other with the ratio of the feed rate of the member to the feed rate of the abrasive tape kept not higher than 1/1.

Thus in accordance with the method of the present invention, the stain on the surface of the member to be cleaned without the problem of the danger of ignition, air pollution and the like and without fear of scratching the surface since the surface is cleaned by an abrasive tape comprising a flexible substrate and an abrasive layer thereon. Further by selecting the roughness of the abrasive tape, the surface of the member to be cleaned can be provided with a desired surface roughness.

Further, since the abrasive tape and the member to be cleaned are fed in opposite directions and the member to be cleaned is fed at a lower rate than the abrasive tape, cuttings of projecting portions of the extrinsic substances on the surface are removed by the abrasive tape and accordingly secondary generation of scratches due to the cutting can be avoided, whereby the extrinsic substances can be removed without scratching the surface. Thus the method of the present invention is a very efficient cleaning method providing a high yield.

When the thickness of the abrasive tape is not larger than 75 μm, the stiffness of the abrasive tape becomes proper, and the cleaning effect becomes excellent especially when the member to be cleaned is of glass. Further the width of the abrasive tape is preferably not larger than 10 inches in that the condition of removal of the stain or the extrinsic substances can be visually checked and that since the abrasive tape can be in contact with the member to be cleaned under a uniform force in the transverse direction of the abrasive tape, the extrinsic substances can be uniformly removed.

Since the cleaning method of the present invention uses an abrasive tape having hard abrasive grains, the cleaning method of the present invention is more effective for cleaning a flat glass member which is relatively high in surface hardness than for cleaning a metal member which is relatively low in surface hardness.

The extrinsic substances are not substances intrinsic to the member to be cleaned but substances from the environment which adhered to the member during manufacture of the same. For example, in the case that the member to be cleaned is a material used in a precision processing such as a glass substrate, an aluminum substrate or a silicon wafer, the extrinsic substances include substances from the human body such as components of sweat (e.g., protein, Na, Mg and bilirubin) and fatty components (e.g., trycetine); dust-resistant coating components such as alkyd resin, urethane resin and wall materials of inorganic silicon materials; components of antistatic agents such as carbon-containing resins and doping resins for antistatic agents); substances from processing materials such as solder flux, sealing resin and oilless resin; and splash of the materials of the substrates such as silicon, glass, aluminum, liquid-crystal and ITO film which exist in a clean room or the like and adhere to the surface of the substrates as extrinsic stain.

That is, the extrinsic substances are substances which should not exist on the surface of the member to be cleaned in order for the member to meet the final requirements to the member.

DETAILED DESCRIPTION OF THE INVENTION

The method of the present invention will be described in more detail, hereinbelow.

As described above, in accordance with the present invention, the abrasive tape and the member to be cleaned are fed in substantially opposite directions with the abrasive layer of the abrasive tape and the surface of the member kept in contact with each other with the ratio of the feed rate of the member to the feed rate of the abrasive tape kept not higher than 1/1. Preferably the ratio of the feed rates is not higher than 1/3 and more preferably not higher than 1/10.

Though may be applied to any member to be cleaned, the method of the present invention can be effectively applied to members of glass, ceramics, metal or plastics such as polycarbonate. Among those, members formed of glass or ceramics which are high in surface hardness and in stiffness are preferable. Members of glass are especially preferable as described above.

In the cleaning method of the present invention, it is preferred that the following conditions be satisfied in addition to the ratio of the feed rate of the member to be cleaned to the feed rate of the abrasive tape.

The relative speed at which the member to be cleaned and the abrasive tape are fed in opposite directions relative to each other is generally in the range of 10 to 6000 mm/sec, and preferably in the range of 30 to 5000 mm/sec.

When the relative speed is lower than 10 mm/sec, it becomes difficult to completely remove the extrinsic substances and when it is higher than 5000 mm/sec, the surface to be cleaned becomes apt to be scratched.

It is preferred that the abrasive tape be pressed against the member to be cleaned by a pressing roll when the abrasive tape and the member are fed in contact with each other. The diameter of the pressing roll is generally in the range of 5 to 600 mmϕ, and preferably in the range of 5 to 100 mmϕ.

When the diameter of the pressing roll is too small, the nipping area becomes small and the efficiency of stain removal deteriorates, and when the diameter of the pressing roll is too large, the nipping area becomes large and the surface of the member becomes apt to be scratched.

The pressing load at which the abrasive tape is pressed against the member to be cleaned is generally 5 to 500 g, and preferably 50 to 300 g. When the pressing load is too small, it becomes difficult to remove the extrinsic substances from the member overcoming the adhesive force of the extrinsic substances to the member, and when the pressing load is too large, the surface of the member becomes apt to be scratched.

The pressing roll should be not larger than 290 mm in the width, preferably not larger than 100 mm and more preferably not larger than 50 mm.

When the width of the pressing roll is too large, it becomes difficult to visually check the condition of removal of the stain or the extrinsic substances and it becomes difficult to apply a uniform load to the roll and to uniformly remove the extrinsic substances from the member.

The nipping pressure of the pressing roll is preferably in the range of 0.1 to 100 g/mm.

When the nipping pressure is too small, stain cannot be sufficiently removed and when it is too large, the abrasive tape can scratches the surface of the member to be cleaned.

The abrasive grains contained in the abrasive layer of the abrasive tape which is employed to carry out the method of the present invention should be in the range of 0.05 to 1 μm in the mean particle size, and preferably in the range of 0.5 to 0.1 μm. The center line average surface roughness Ra of the abrasive tape is preferably 5 to 100 μm (cut-off value of 0.08 mm).

The abrasive tape feed rate, when the abrasive tape is fed out from a supply reel and the abrasive tape is brought into contact with the surface of the member to be cleaned while applying a back tension to the abrasive tape, is, for instance, 10 cm to 1000 cm/min. The abrasive tape may be oscillated in a direction crossing the direction of feed of the abrasive tape, for instance at 0 to 10 mm/sec. That is, the member to be cleaned may be moved in the transverse direction by 0 to 5 mm each time the abrasive tape is fed by 10 mm. Otherwise the member may be fed obliquely. The abrasive tape is taken up around a take-up reel under a tension of 5 to 500 g per a width of 10 mm.

For example, the following abrasive grains can be employed in the abrasive layer of the abrasive tape. Chromium oxide grains, α-alumina grains, silicon carbide grains, non-magnetic iron oxide grains, diamond grains, γ-alumina grains, α,γ-alumina grains, fused alumina grains, cerium oxide grains, corundum grains, artificial diamond grains, garnet grains, emery (major constituents: corundum and magnetite) grains, silica grains, silicon nitride grains, boron nitride grains, molybdenum carbide grains, boron carbide grains, tungsten carbide grains, titanium carbide grains. One of the above-enumerated abrasive grain materials having a Mohs hardness of not less than 6 may be used alone, or two to four materials may be used in combination. The abrasive grain mixtures should be 2 to 10 in pH, and preferably 5 to 10 in pH. The abrasive grains are used as the major component of the abrasive layer.

The abrasive layer may contain carbon black. As the carbon black, furnace black for rubber, thermal black for rubber, coloring black, and acetylene black can be used. The carbon black is used as a light blocking agent, a friction coefficient regulating agent, and a durability improving agent as well as an antistatic agent aforesaid condition is especially preferred.

The carbon black has a mean grain diameter within the range of 5 to 1000 μm (as measured with an electron microscope), a specific surface area within the range of 1 $m^2/g$ to 800 $m^2/g$ (as measured with the nitrogen adsorption method), a pH value within the range of 4 to 11 (as measured with the JIS K-6221-1982 method), and a dibutyl phthalate (DBP) oil absorption within the range of 10 ml/100 g to 800 ml/100 g (as measured with the JIS K-6221-1982 method). In the present invention, in cases where the carbon black is utilized in order to decrease the surface electrical resistance of the coating film, the carbon black having a size within the range of 5 to 100 nm is employed. Also, in cases where the carbon black is utilized in order to control the strength of the coating film, the carbon black having a size within the range of 50 to 1,000 μm is employed.

As the binder in the abrasive layer, known thermoplastic resins, thermosetting resins, reactive resins, electron beam-curing resins, ultraviolet-curing resins, visible light-curing resins and mixtures of two or more of these resins can be used. The thermoplastic resins, which may be used as the binder resin, generally have a softening point of 150° C. or lower, an average molecular weight within the range of approximately 10,000 to approximately 300,000, and a polymerization degree within the range of approximately 50 to approximately 2,000. The polymerization degrees of the thermoplastic resins should preferably fall within the range of approximately 200 to approximately 700. Specifically, as the thermoplastic resin, it is possible to use, for example, a vinyl chloride-vinyl acetate copolymer, a vinyl chloride copolymer, a vinyl chloride-vinyl acetate-vinyl alcohol copolymer, a vinyl chloride-vinyl alcohol copolymer, a vinyl chloride-vinylidene chloride copolymer, a vinyl chloride-acrylonitrile copolymer, an acrylic ester-acrylonitrile copolymer, an acrylic ester-vinylidene chloride copolymer, an acrylic ester-styrene copolymer, a methacrylic ester-acrylonitrile copolymer, a methacrylic ester-vinylidene chloride copolymer, a methacrylic ester-styrene copolymer, a urethane elastomer, a nylon-silicone resin, a nitrocellulose-polyamide resin, polyvinyl fluoride resin, a vinylidene chloride-acrylonitrile copolymer, a butadiene-acrylonitrile copolymer, a polyamide resin, a polyvinyl butyral resin, a cellulose derivative (such as cellulose acetate butyrate, cellulose diacetate, cellulose triacetate, cellulose propionate, nitrocellulose, ethyl cellulose, methyl cellulose, propyl cellulose, methyl ethyl cellulose, carboxymethyl cellulose, or acetyl cellulose), a styrene-butadiene copolymer, a polyester resin, a polycarbonate resin, a chlorovinyl ether-acrylic ester copolymer, an amino resin, a synthetic rubber type thermoplastic resin, or a mixture of two or more of these compounds.

The thermosetting resins or the reactive resins, which may be used as the binder resin in the abrasive layer of the abrasive tape in accordance with the present invention generally have a molecular weight of 200,000 or less when the resins takes on the form of coating compositions. When the coating compositions are heated and humidified after being applied onto substrates and dried, the resins exhibit an infinite increase in the molecular weight through the condensation reactions, the addition reactions, or the like. It is preferable that the resins of these types do not soften or melt before they decompose thermally. Specifically, the thermosetting resins or the reactive resins include, for example, a phenol resin, a phenoxy resin, an epoxy resin, a polyurethane resin, a polyester resin, a polyurethane polycarbonate resin, a urea resin, a melamine resin, an alkyd resin, a silicone resin, an acrylic reactive resin (an electron beam-curing resin), an epoxy-polyamide resin, a nitrocellulose melamine resin, a mixture of a high-molecular weight polyester resin with an isocyanate prepolymer, a mixture of a methacrylate copolymer with a diisocyanate prepolymer, a mixture of a polyester polyol with a polyisocyanate, a urea-formaldehyde resin, a mixture of a low-molecular weight glycol, a high-molecular weight diol and a triphenylmethane triisocyanate, a polyamine resin, a polyimine resin, and a mixture of two or more of these compounds. In general, the thermoplastic resins, the thermosetting resins, and the reactive resins described above respectively have their major functional groups, and one to six kinds of other functional groups. Each of the other functional groups should preferably be contained in proportions within the range of $1\times10^{-6}$ equivalent to $1\times10^{-2}$ equivalent per gram of the resin. Examples of the other functional groups are acid groups, such as a carboxylic acid group (COOM), a sulfinic acid group, a sulfenic acid group, a sulfonic acid group ($SO_3M$), a phosphoric acid group (PO(OM)(OM)), a phosphonic acid group, a sulfuric acid group ($OSO_3M$), and ester groups with these acids, wherein M represents H, an alkali metal, an alkaline earth metal, or a hydrocarbon group; groups of amphoteric compounds, such as a group of an amino acid, a group of an aminosulfonic acid, a group of a sulfuric ester of amino-alcohol, a group of a phosphoric ester of amino-alcohol, a sulfobetaine form group, a phosphobetaine form group, and an alkyl betaine form group; basic groups, such as an amino group, an imino group, an imido group, and an amido group; a hydroxyl group; an alkoxyl group; a thiol group; an alkylthio group; halogen groups, such as F, Cl, Br, and I; a silyl group; a siloxane group; an epoxy group; an isocyanato group; a cyano group; a nitrile group; an oxo group; an acryl group; and a phosphine group.

These resins may be employed alone or in combination of one or more of other resins and may be added with one or more additives.

The amount of the binder per 100 parts by weight of abrasive grains in the abrasive layer should be within the range of 5 to 70 parts by weight. As the polyisocyanates, it is possible to use, for example, isocyanates, such as tolylene diisocyanate, 4,4'-diphenylmethane diisocyanate, hexamethylene diisocyanate, xylylene diisocyanate, naphthylene-1,5-diisocyanate, o-toluidine diisocyanate, isophorone diisocyanate, and triphenylmethane triisocyanate. As the polyisocyanates, it is also possible to use products of reactions between the above-enumerated isocyanates and polyalcohols, and dimer to decamer polyisocyanates produced from condensation of isocyanates, and products which are obtained from reactions between polyisocyanates and polyurethanes and which have isocyanate groups as terminal functional groups. The polyisocyanates enumerated above should preferably have an average molecular weight falling within the range of 100 to 20,000. Such polyisocyanates are commercially available as Coronate L, Coronate HL, Coronate 2030, Coronate 2031, Myrionate MR, and Myrionate MTL (supplied by Nippon Polyurethane K.K.); Takenate D-102, Takenate D-110N, Takenate D-200, Takenate D-202, Takenate 300S, and Takenate 500 (supplied by Takeda Chemical Industries, Ltd.); Sumidur T-80, Sumidur 44S, Sumidur PF, Sumidur L, Sumidur N, Desmodur L, Desmodur IL, Desmodur N, Desmodur HL, Desmodur T65, Desmodur 15, Desmodur R, Desmodur RF, Desmodur SL, and Desmodur Z4273 (supplied by Sumitomo Bayer K.K.). These polyisocyanates may be used alone or as a mixture of two or more thereof different in curing reaction properties. In order to promote the curing reaction, compounds having a hydroxyl group (such as butanediol, hexanediol, polyurethane having a molecular weight within the range of 1,000 to 10,000, and water), compounds having an amino group (such as monomethylamine, dimethylamine, and trimethylamine), catalysts, such as metal oxides and iron acetylacetonate, may be used together with the polyisocyanates. The compounds having a hydroxyl group or an amino group should preferably be polyfunctional. The proportions of the polyisocyanate used in each of the abrasive layer and the backing layer should preferably fall within the range of 2 to 70 parts by weight per 100 parts by weight of the total of the binder resin and the polyisocyanate, and should more preferably fall within the range of 5 to 50 parts by weight per 100 parts by weight of the total of the binder resin and the polyisocyanate.

Powder lubricating agents may be added to the abrasive layer. Examples of the powder lubricating agents include fine grains of inorganic materials, such as graphite, molybdenum disulfide, boron nitride, graphite fluoride, calcium carbonate, barium sulfate, silicon oxide, titanium oxide, zinc oxide, tin oxide, and tungsten disulfide; and fine grains of resins, such as an acryl-styrene resin, a benzoguanamine resin, a melamine resin, a polyolefin resin, a polyester resin, a polyamide resin, a polyimide resin, and a polyfluoroethylene resin.

Further various organic compound lubricating agents may be added to the abrasive layer. Examples of such organic compound lubricating agent include compounds into which fluorine or silicon is introduced, such as a silicone oil (e.g., a dialkyl polysiloxane, a dialkoxy polysiloxane, a phenyl polysiloxane, or a fluoroalkyl polysiloxane) (KF96, KF69 and the like from Shinetsu Chemical), a fatty acid-modified silicone oil, a fluorine alcohol, a polyolefin (e.g., a polyethylene wax or a polypropylene), a polyglycol (e.g., ethylene glycol or a polyethylene oxide wax), a tetrafluoroethylene oxide wax, a polytetrafluoroglycol, a perfluoroalkyl ether, a perfluorofatty acid, a perfluorofatty acid ester, a perfluoroalkylsulfuric ester, a perfluoroalkylsulfonic ester, a perfluoroalkylbenzenesulfonic ester, and a perfluoroalkylphosphoric ester; organic acids and organic acid ester compounds, such as an alkylsulfuric ester, an alkylsulfonic ester, an alkylphosphonic triester, an alkylphosphonic monoester, an alkylphosphonic diester, an alkylphosphoric ester, and a succinic ester; heterocyclic compounds containing nitrogen or sulfur, such as triazaindolizine, tetraazaindene, benzotriazole, benzotriazine, benzodiazole, and EDTA; a fatty acid ester of a monobasic fatty acid having 10 to 40 carbon atoms with at least one or more of a monohydric alcohol, a dihydric alcohol, a trihydric alcohol, a tetrahydric alcohol and a hexahydric alcohol having 2 to 40 carbon atoms; a fatty acid ester of a monobasic fatty acid having at least 10 carbon atoms with such an monohydric, dihydric, trihydric, tetrahydric, pentahydric or hexahydric alcohol that the sum of the number of the carbon atoms of the fatty acid and the number of the carbon atoms of the alcohol falls within the range of 11 to 70; and fatty acids, fatty acid amides, fatty acid alkyl amides, and aliphatic alcohols having 8 to 40 carbon atoms. Such an organic compound lubricating agent may, for example, be butyl caprylate, octyl caprylate, ethyl laurate, butyl laurate, octyl laurate, ethyl myristate, butyl myristate, octyl myristate, 2-ethylhexyl myristate, ethyl palmirate, butyl palmitate, octyl palmitate, 2-ethylhexyl palmitate, ethyl stearate, butyl stearate, isobutyl stearate, octyl stearate, 2-ethylhexyl stearate, amyl stearate, isoamyl stearate, 2-ethylpentyl stearate, 2-hexyldecyl stearate, isotridecyl stearate, stearic acid amide, stearic acid alkyl amide, butoxyethyl stearate, anhydrosorbitan monostearate, anhydrosorbitan distearate, anhydrosorbitan tristearate, anhydrosorbitan tetrastearate, oleyl oleate, oleyl alcohol, lauryl alcohol, montan wax, or carnauba wax. Each of these organic compound lubricating agents may be used alone or in combination with one or more of the others.

When the abrasive layer is to be formed, the constituents described above are selected appropriately and dissolved in the organic solvents, and a coating composition is thereby prepared. The coating composition is applied onto the flexible substrate and dried, and oriented if necessary. The substrate of the abrasive tape is preferably 2.5 to 500 microns in thickness and more preferably 3 to 50 microns in thickness. Further it is preferred that the Young's modulus of the substrate in either one of the longitudinal direction and the transverse direction be not lower than 400 kg/mm$^2$. Examples of the materials for the substrate include polyesters, such as a polyethylene terephthalate and a polyethylene naphthalate; polyolefins, such as a polypropylene; cellulose derivatives, such as cellulose triacetate and cellulose diacetate; vinyl resins, such as a polyvinyl chloride; plastic materials, such as a polycarbonate, a polyimide, a polyamide, a polysulfone, a polyphenylsulfone, and a polybenzoxazole; metals, such as aluminum and copper; and ceramic materials, such as glass. Among the above-enumerated materials, the polyethylene naphthalate and the polyamide are preferable. Before the coating composition is applied onto the flexible substrate, the flexible substrate may be subjected to corona discharge treatment, plasma treatment, prime-coating treatment, heat treatment, dust-resistant treatment, metal vapor evaporation treatment, and/or alkali treatment. There are descriptions on the substrate for the abrasive tape, for instance, in West German Patent No. 3338854A, Japanese Unexamined Patent Publication Nos. 59(1984)-116926 and 61(1986)-129731, U.S. Pat. No. 4,388,368, and "Fibers and Industry" by Yukio Mitsuishi, Vol. 31, pp50 to 55, 1975. The center line average surface roughness of the substrate is preferably 0.001 to 1.5 μm (cut-off value of 0.25 mm).

No limitation is imposed on how the dispersion and kneading processes are carried out. The order, in which the constituents (the resins, the grains, the lubricants, the solvents, and the like) are added, the timing, with which the constituents are added during the dispersion and kneading processes, the temperature at which the dispersion process is carried out (and which will ordinarily fall within the range of 0° C. to 80° C.), and the like, may be selected appropriately. One of various types of kneading machines may be used in order to prepare the coating compositions for the abrasive layer and the back layer. For example, it is possible to use a twin roll mill, a triple roll mill, a ball mill, a pebble mill, a trommel, a sand grinder, a Szegvari attritor, a high-speed impeller, a dispersing machine, a high-speed stone mill, a high-speed impact mill, a disperser, a kneader, a high-speed mixer, a ribbon blender, a Ko-kneader, an intensive mixer, a tumbler, a blender, a homogenizer, a single-screw extruder, a twin-screw extruder, or an ultrasonic dispersing machine. Normally, dispersion and kneading processes are continuously carried out using a plurality of dispersing and kneading machines. The dispersion and kneading is described in detail, for instance, in "Paint Flow and Pigment Dispersion" by T. C. Patton published from John Wiley & Sons, 1964, "Industrial Material" Vol. 25, 37, 1977, by Shinichi Tanaka and the literature cited therein. In order to efficiently carry out the dispersion and kneading, ancillary materials such as steel balls, steel beads, ceramic beads, glass beads, organic polymer beads and the like having a sphere-equivalent diameter of 10 cmϕ to 0.05 mmϕ can be used, though they need not be spherical. The dispersion and kneading is described also in U.S. Pat. Nos. 2,581,414, 2,855,156 and the like. In this invention, the coating compositions for the abrasive layer and the back coating layer can be prepared according to the methods shown in the books, the literature cited in the books, and the patent publications.

When the coating composition for the abrasive layer are to be applied onto the flexible substrate, the viscosity of the coating composition may be adjusted at a value falling within the range of 1 to 20,000 centistokes at 25° C. The coating composition may be applied onto the substrate by using any of coating apparatuses, for example, an air doctor coater, a blade coater, an air-knife coater, a squeeze coater, an impregnation coater, a reverse-roll coater, a transfer roll coater, a gravure coater, a kiss-roll coater, a cast coater, a spray coater, a rod coater, a forward-rotation roll coater, a curtain coater, an extrusion coater, a bar coater, or a lip coater. See, for example, "Coating Engineering" pp. 253 to 277, Mar., 20, 1971, Asakura Shoten. The coating compositions may be applied in any order. A prime coating layer may be applied to the substrate before application of the respective coating compositions, and the substrate may be subjected to corona discharge treatment before application of the respective coating compositions in order to enhance bonding force of the coating to the substrate. When the abrasive layer and/or back coating layer is to be formed of a plurality of layers, the layers may be applied to the substrate at one time or in sequence. See, for instance, Japanese Patent Publication No. 62(1987)-37451 and Japanese Unexamined Patent Publication Nos. 57(1982)-123532, 59(1984)-142741 and 59(1984)-165239.

The coating composition applied to the flexible substrate in a thickness of about 1 to 100 μm in the manner described above is immediately subjected to multistage drying treatment at 20° to 130° C. The abrasive layer thus formed is dried into a thickness of 0.1 to 10 μm. Normally the substrate is transferred at a speed of 10 to 900 m/min and the drying temperature in the respective drying zones is controlled to 20° to 130° C. so that the amount of residual solvent in the applied film becomes 0.1 to 40 mg/m$^2$. If necessary, the back coating layer is formed in the similar manner. Thereafter the layers are subjected to surface smoothing treatment to a centerline mean surface roughness of 0.001 to 0.3 microns (cut-off 0.25 mm) and then the web is cut into a desired shape. It is preferred that the pretreatment and the surface treatment of the grains, the kneading and dispersion, the application, orientation and drying, smoothing, heat treatment, EB treatment, surface cleaning, cutting and take-up be carried out continuously. The abrasive tape web which has been prepared in the manner described above is cut into abrasive tapes, and each abrasive tape is wound around a desired plastic or metal reel. Before or immediately before the abrasive tape is wound around the reel, the abrasive tape (specifically, the abrasive layer surface, the back coating layer surface, the edge surfaces, and/or the base surface on the back side) should preferably be burnished and/or cleaned. The burnishing process is carried out in order to adjust the surface roughness and the polishing performance of the abrasive tape. Specifically, protrusions on the surface of the abrasive tape are scraped out, and the surface of the abrasive tape is thereby made uniform or smooth by using a hard material, such as a sapphire blade, a shaving blade, a super-hard material blade, a diamond blade, or a ceramic blade. No limitation is imposed on the hardness of the material used for the burnishing process, and any of materials, which can remove protrusions on the surface of the abrasive tape, may be employed. However, the Mohs hardness of the material used for the burnishing process should preferably be 8 or higher. The materials need not necessarily take on the form of blades and may have other shapes, such as square, round, and wheel shapes. (The material may be provided on the circumferential surface of a rotatable cylinder.) The cleaning process is carried out in order to remove foreign substances, excessive lubricating agents, and the like, from the surface of the abrasive tape. For this purpose, the abrasive layer surface, the back coating layer surface, the edge surfaces, and the base surface on the back side are wiped with a nonwoven fabric, or the like. As the wiping materials, it is possible to use, for example, various Vilene products supplied by Japan Vilene Co., Ltd., Toraysee and Ecsaine supplied by Toray Industries, Inc., a material available as Kimwlpe (trade name), a nylon unwoven fabric, a polyester unwoven fabric, a rayon unwoven fabric, an acrylonitrile unwoven fabric, a mixed unwoven fabric, and tissue paper.

The present invention will further be illustrated by the following non-limitative example. In the example, the term "parts" means parts by weight.

Example and Control

A prime-coating layer constituted of a polyester polyurethane resin was applied to a thickness of 0.1 μm onto a flexible polyethylene terephthalate substrate 25 μm in thickness and an abrasive layer having the following composition was formed on the prime-coating layer in a thickness of 10 μm. Thus an abrasive tape was prepared.

| Abrasive coating composition: | |
|---|---|
| Abrasive grains (alumina) (granular, mean grain diameter: 0.1 μm, Mohs hardness: 9) | 95 parts |
| Abrasive grains (diamond) (granular, mean grain diameter: 0.5 μm, Mohs hardness: 10) | 5 parts |
| Binder (polyester resin) | 7 parts |
| Binder (polyurethane resin) (containing sodium sulfonate in a proportion of $2 \times 10^{-3}$ equivalent per g of the resin, Mw: 70,000) | 7 parts |
| Binder (polyisocyanate) (a reaction product of 3 mols of tolylene diisocyanate with 1 mol of trimethylolpropane) | 4 parts |
| Dispersing agent (phosphanol 610; a phosphoric ester of ethylene glycol) | 2 parts |
| Lubricating agent (stearic acid/oleic acid/butyl stearate = 1/1/1) | |
| Additive (carbon black) | 3 parts |

Members which were 1.2 mm in thickness and 20 angstroms in centerline mean surface roughness Ra and to which fingerprints adhered as an extrinsic substance were cleaned under various conditions shown in table 1.

Rates of removal of the extrinsic substance were evaluated by measuring the rate of reduction in the intensity of fluorescence by use of a fluorescence microscope. The result is shown in table 1.

TABLE 1

| | width of tape (mm) | relative speed (mm/sec) | tape speed (mm/sec) | member speed (mm/sec) | extrinsic substance | rate of removal |
|---|---|---|---|---|---|---|
| example 1 | 12.65 | 11 | 10 | 1 | fingerprint abrasive tape | 100% |
| example 2 | 12.65 | 15 | 15 | 1 | fingerprint abrasive tape | 100% |
| control 1 | 12.65 | 11 | 10 | 1 | fingerprint Kimwipe | 36% |
| control 2 | 12.65 | 11 | 10 | 1 | fingerprint cotton fabric | 45% |
| control 3 | 12.65 | 11 | 10 | 1 | fingerprint unwoven fabric | 51% |
| control 4 | 12.65 | 11 | 10 | 1 | fingerprint Freon 113 | 100% |
| control 5 | 12.65 | 11 | 10 | 1 | fingerprint razor blade skiving | 62% |

What is claimed is:

1. A method of cleaning a surface to remove extrinsic substances thereon comprising:

an abrasive tape comprising an abrasive layer primarily containing abrasive grains and a binder and formed on a flexible substrate; and a member to be cleaned;

wherein said method comprises the step of feeding said abrasive tape and said member to be cleaned in substantially opposite directions to each other while said abrasive layer is in contact with the surface of said member to be cleaned at a feeding rate ratio of the member to be cleaned to the abrasive tape not higher than 1/1; and wherein said method step does not scratch the surface of the member to be cleaned.

2. A method as defined in claim 1 in which said abrasive tape is not larger than 10 inches in width and not larger than 75 μm in thickness.

3. A method as defined in claim 1 or 2 in which said member to be cleaned is of glass.

4. A method as defined in claim 1, wherein said member to be cleaned is selected from the group consisting of glass, ceramics, metal and plastics.

5. A method as defined in claim 4, wherein said member to be cleaned is glass.

6. A method as defined in claim 1, wherein said member to be cleaned is a substrate-like shaped glass.

7. A method as defined in claim 1, wherein said member to be cleaned is moved in a linear motion.

8. A method as defined in claim 1, wherein said method step is an abrading method for removing extrinsic substances on a surface of the member to be cleaned.

9. A method of cleaning a surface to remove extrinsic substances thereon comprising:

an abrasive tape comprising an abrasive layer primarily containing abrasive grains and a binder and formed on a flexible substrate; and a member to be cleaned;

wherein said method comprises the step of feeding said abrasive tape and said member to be cleaned in substantially opposite directions to each other while said abrasive layer is in contact with the surface of said member to be cleaned, wherein said member to be cleaned and said abrasive tape are fed in a linear, reciprocating movement at a relative speed between the member to be cleaned and the abrasive tape of from 30–5,000mm/sec; and wherein said method step does not scratch the surface of the member to be cleaned.

* * * * *